US006856229B2

(12) United States Patent
Ogawa et al.

(10) Patent No.: US 6,856,229 B2
(45) Date of Patent: Feb. 15, 2005

(54) ELECTRONIC CHIP COMPONENT AND MANUFACTURING METHOD THEREOF

(75) Inventors: Hideki Ogawa, Takasaki (JP); Nobuhiro Umeyama, Fujioka (JP)

(73) Assignee: Taiyo Yuden Co., Ltd., Gunma (JP)

( * ) Notice: Subject to any disclaimer, the term of this patent is extended or adjusted under 35 U.S.C. 154(b) by 0 days.

(21) Appl. No.: 10/012,103

(22) Filed: Dec. 3, 2001

(65) Prior Publication Data

US 2002/0125979 A1 Sep. 12, 2002

Related U.S. Application Data

(62) Division of application No. 09/492,856, filed on Nov. 27, 2000, now Pat. No. 6,393,691.

(30) Foreign Application Priority Data

Jan. 28, 1999 (JP) ..... 11-020265
Dec. 21, 1999 (JP) ..... 11-362245

(51) Int. Cl.[7] ..... H01F 5/00
(52) U.S. Cl. ..... 336/200; 336/223; 336/232
(58) Field of Search ..... 336/200, 223, 336/232, 83, 96

(56) References Cited

U.S. PATENT DOCUMENTS 6,131,041 A * 10/2000 Takeda et al. ..... 455/550
6,154,112 A * 11/2000 Aoba et al. ..... 336/192
6,157,283 A * 12/2000 Tsunemi ..... 336/192
6,194,248 B1 * 2/2001 Amaya et al. ..... 438/110
6,249,203 B1 * 6/2001 Hanato et al. ..... 336/185
6,298,544 B1 * 10/2001 Hsu ..... 29/600
6,388,550 B1 * 5/2002 Kanetaka et al. ..... 336/223
6,393,691 B1 * 5/2002 Ogawa et al. ..... 29/602.1
6,492,885 B1 * 12/2002 Murata et al. ..... 333/185
6,609,009 B1 * 8/2003 Kiyosue et al. ..... 455/550

* cited by examiner

*Primary Examiner*—Anh Mai
(74) *Attorney, Agent, or Firm*—Townsend & Banta

(57) ABSTRACT

The present invention provides an electronic chip component (e.g., a chip inductor) small in size, and a manufacturing method thereof capable of shaping of the outer dimensions of the component into a desirable shape. The method involves press-fitting a chip inductor element into a component storage section of a mold plate comprised of a heat resistant rubber elastic member including the component storage section, while a resin coating material is coated on the element and dried to a dry-to-touch state, thereby hardening the resin coating material and automatically shaping the chip inductor element into a desired outer shape.

3 Claims, 7 Drawing Sheets

FORM CORE
7

SINTER CORE
2
1
2

FORM EXTERNAL ELECTRODE
15
1
15

WIND COIL AND CONDUCT SOLDERING
11
15
15
8

COAT AND HANDLE OUTER PACKAGING RESIN
14

PLATE EXTERNAL ELECTRODES
17
17
14

ELECTRONIC CHIP COMPONENT AND MANUFACTURING METHOD THEREOF

This is a division of application Ser. No. 09/492,856 filed Jan. 27, 2000 U.S. Pat. No. 6,393,691.

FIELD OF THE INVENTION

The present invention relates to the structure of an electronic chip component for surface mounting and an electronic chip component manufacturing method thereof. In particular, an electronic chip component (such as a chip inductor) and a method of manufacturing thereof is provided, wherein the electronic chip component is coated with an outer packaging material such as a resin.

BACKGROUND OF THE INVENTION

To perform high density automatic surface mounting with respect to a circuit board using a chip mounter (automatic chip mounting machine), electronic component elements such as resistive elements, capacitors and inductors are made small in size, and the elements are coated with a resin (normally thermosetting resin) or the like as an outer packaging material to thereby form a cylindrical or rectangularly shaped chip.

In this respect, as a winding type chip inductor in which a coil is wound around the core portion of a core, a spiral inductor having a structure in which a coil is wound around the core portion of a double enveloping core (barbell-like core) and soldered to external electrodes made of metallic plates provided on flange portions on both ends of the coil, respectively, is well known. With an inductor of this type, however, possible damage to the inductor may occur during mounting or handling, due to the exposed coil.

In view of this deficiency, a resin molded chip inductor 10, as shown in FIGS. 5(A) and 5(B) is proposed. The resin molded chip inductor is manufactured by injection molding resin 9 as an outer packaging material to entirely surround a chip inductor element formed by soldering, and connecting the ends of a coil 8 wound around the core portion 1 of a double enveloping core 7 to external electrodes 5 comprised of metallic lead frames and provided on both flange portions 2, 2 of the double enveloping core 7, respectively, whereby part of the external electrodes 5 form a rectangular outer shape by curving the tip ends of the external electrodes 5 into an L-shape.

The double enveloping core 7 used for the above chip inductor 10 is made of a magnetic material such as high resistance nickel-zinc ferrite or an insulating material such as alumina. The resin 9 as the outer packaging material is epoxy synthetic resin formed by, for example, injection molding. The coil 8 is an insulating material coated conductor (wherein the insulating coating material is polyurethane or polyamideimide) having a diameter of about 0.05 to 0.2 mm. Depending on the purpose, one single wire or paired wires may be used for the coil 8.

As shown in FIG. 6, the core portion 1 of the double enveloping core 7 is formed between external electrodes 15 which have directly bonded electrode structure thereon by printing and baking conductor paste to flange portions 2, 2 on both ends of the core portion 1. A resin coating material (normally thermosetting resin coating material) 14 is coated around the coil 8 as an outer packaging and the resin coating material 14 thus coated on the coil 8 is heated and hardened. Through this process, a very small chip inductor 20 can be made.

In addition to the above proposed manufacturing method for the chip inductor 10 shown in FIG. 5 comprising injection-molding resin 9 serving as an outer packaging material, as shown in FIG. 6, there is proposed a manufacturing method comprising coating a resin coating material 14 serving as an outer packaging material stored in a coating material pan 23 on the periphery of a chip inductor element 11, having the core portion 1 of a double enveloping core 7 put crosswise and the end portions of the coil 8 soldered and connected to directly bonded external electrodes 15, provided on both flange portions of the core portion 1 by means of a coater 27, by rotation of the coating disk 24. Meanwhile, the element is held by a product chunk 22 and rotated by a rotating drum disk 21, and heating and hardening of the resin coating material 14 thus coated is carried out, finally plating the external electrodes.

Namely, as described in the flowchart (shown as FIGS. 7(A)–7(F)), the chip inductor 20 is manufactured by sequentially conducting the following steps:

(a) forming a double enveloping core 7 (FIG. 7(A));

(b) sintering the core 7 (FIG. 7(B));

(c) forming external electrodes (15) directly bonded to flange portions 2, 2 on both ends of the core 7 by printing and baking conductor paste such as silver, silver-platinum or copper (FIG. 7(C));

(d) winding the coil 8 around a core portion 1, and soldering both ends of the core 7 to the external electrodes (15), respectively, thereby forming an inductor element 11 (FIG. 7(D));

(e) coating the coil 8 with an epoxy synthetic resin coating material to form a heat resistant resin coating material 14 (FIG. 7(E)); and (f) plating the external electrodes 15 to form a plated layer 17 by tin plating, nickel plating, solder plating or a combination thereof (this step may be omitted in certain cases) (FIG. 7(F)).

A conventional chip inductor 10, wherein the entire element is coated with resin, becomes considerably larger in size than the outer dimensions of the element. Therefore, a conventional electronic chip component of this type is not suited to be made small in size.

With an electronic chip component such as the above-stated chip inductor 20, downsizing of the electronic component almost in compliance with a layered magnetic capacitor and the formation of the electronic component into a chip is possible, but in the outer packaging formation step, the coat formed by coating the resin coating material 14 around the coil 8 by means of the coater 27 becomes barrel-shaped having a swollen central portion as indicated by reference numeral 20, as shown in FIG. 6. This makes it difficult to stably mount these components during surface mounting and results in an increase in the outer dimension of the element. Thus, the barrel shape is not preferable for making an electronic chip component small in size.

In the case of a resin mold type chip conductor, by contrast, which uses a so-called injection molding manufacturing method for arranging an element in a mold formed into a chip shape in almost the same dimensions as a desired element and injecting resin into the mold at high pressure, the resin is directly sprayed onto the element main body at high pressure. During this process, the injected resin strongly strikes against a wound coil 8 portion and an irregular winding disadvantageously tends to occur. Further, when injection molding is conducted using thermosetting resin, it becomes difficult to recycle the resin on a runner portion, and material cannot be effectively used. Besides, when a small gap exists between the element within the mold and the inner wall of the mold, e.g., when the coil is fully wound around the core put between both flange portions up to the outer dimensional limit, there is a fear that resin may not be sufficiently filled deep within the mold.

Moreover, there are cases where magnetic powder containing resin (which normally contains magnetic powder of 55% or less by weight) is used as an outer packaging material so as to enhance the magnetic characteristics of the chip inductor. To form resin having a high magnetic powder content (75% by weight or more) into an outer package, there is no avoiding limiting the dimensions of the coil and ensuring an outer packaging material having a certain thickness around the coil, which are disadvantageous for making the inductor smaller in size and making direct current resistance low. It is particularly disadvantageous to the conventional chip conductor using a core having rectangular flanges and a rectangular core portion.

SUMMARY OF THE INVENTION

The present invention has been made in view of the above circumstances. It is an object of the present invention to provide a novel electronic chip component manufacturing method capable of forming an outer packaging material that does not exceed the outer dimensions of a chip inductor element at the time of heating and hardening the outer packaging material for an electronic chip component. Particularly, a chip inductor for which the development of forming it into a chip including dimensional standardization (while elements are mainly custom-made at present) is expected in the future, such as a chip inductor formed by arranging directly bonded external electrodes at the flange portions on the both ends of the core, coating a resin coating material around the coil as an outer packaging material and forming a chip of rectangular (rectangular parallelopiped) shape, cylindrical shape or the like, as well as to provide an electronic chip component suited for this method.

The present invention attains the above object by providing a first embodiment of an electronic chip component having an outer packaging material coating the periphery of an element, wherein the element has flanges on both longitudinal ends, respectively, and a dimensional ratio (t2/t1) of a thickness (t1) of a circumferential thin portion of the outer packaging material formed on the outer periphery of the element to a thickness (t2) of a thick portion of the outer packaging material is not less than 2, so that at least part of the respective flanges are exposed.

In a second embodiment of the present invention, an electronic chip component is provided wherein the outer packaging material is magnetic powder containing resin containing magnetic powder of 75% by weight or more.

In a third embodiment of the present invention, an electronic chip component is provided as described in the second embodiment above, wherein the largest particle size of the magnetic powder contained in the outer packaging material is not more than the thickness (t1) of the circumferential thin portion of the outer packaging material.

As methods of manufacturing the electronic chip components described in (1) to (3) above, the present invention provides an electronic chip component manufacturing method comprising a first step of coating, as an outer packaging material, a resin coating material on the periphery of an element of the electronic component, and a second step of heating and hardening the resin coating material, wherein the electronic chip component coated with the resin coating material is press-fitted into a component storage section having a desired outer shape included in a heat resistant rubber elastic member, so as to elastically deform the component storage section and the electronic chip component together with the heat resistant rubber elastic member, thereby shaping and hardening the resin coating material into a desired shape.

The present invention provides a second electronic chip component manufacturing method comprising a first step of coating a resin coating material on the periphery of an element of the electronic chip component excluding the external electrode disposed region, and a second step of heating and hardening the resin coating material. The second heating and hardening step comprises first press-fitting the electronic chip component coated with the resin coating material into a component storage section, having a desired outer shape, in a mold plate comprised of a heat resistant rubber elastic member including the component storage section, so as to elastically deform the component storage section while the resin coating material coating the electronic component is in a dry-to-touch state, and then heating the electronic component together with the mold plate to thereby harden the resin coating material.

The present invention provides a third electronic chip component manufacturing method comprising a first step of coating a resin coating material on the periphery of a coil of a chip inductor element having external electrodes disposed at flanged portions on both ends of a double enveloping core, with the coil wound around a core portion of the double enveloping core and end portions of the coil thermo-compressed to the external electrodes, and a second heating and hardening step of the resin coating material. The second step comprises press-fitting the chip inductor element into a component storage section having a desired chip outer shape in a mold plate comprised of a heat resistant rubber elastic member including the storage section while the resin coating material coating the chip inductor element is in a dry-to-touch state, and heating the chip inductor element together with the mold plate to thereby harden the resin coating material.

The present invention provides a fourth electronic chip component manufacturing method as described in the third method above, wherein the outer shape of the component storage section of the mold plate shape consists of a plurality of planes or of a combination of a plurality of planes and a round ridgeline.

Furthermore, the present invention provides a fifth electronic chip component manufacturing method as described in the third and fourth methods above, wherein run-off portions, to which excessive resin coating material is extruded when heating the resin coating material, are provided at the flanged portions on the both ends of the double enveloping core of the electronic chip component or portions of the component storage section corresponding to the flanged portions.

Further, the present invention provides a sixth electronic chip component manufacturing method comprising a first step of coating a resin coating material on the periphery of an element of the electronic chip component excluding an external electrode disposed region, and a second step of heating and hardening the resin coating material comprising pressurizing and heating the electronic component element by a mold plate of a desired shape having stiffness while the resin coating material is in a dry-to-touch state, thereby shaping and hardening the resin coating material into a desired outer shape.

Additionally, the present invention provides a seventh electronic chip component manufacturing method comprising a first step of coating a resin coating material on the periphery of an element of an electronic chip component element excluding an external electrode disposed region, and a second step of heating and hardening the resin coating material, comprising pressurizing and heating the resin coating material using an elastic mold plate of a desired shape while the resin coating material is in a dry-to-touch state, thereby shaping and hardening the resin coating material into a desired outer shape.

The first, second, sixth and seventh manufacturing methods described above may also be used in manufacturing other electronic chip components such as chip capacitors or chip resistors. It is noted that the above-stated dry-to-touch state is a term indicating the dry, hardened state of a coating material in which the coating material does not bond to the fingers when the center of a coated surface is touched. In the present invention, a resin coating material coated on the element as a coating material is in a dry state to the extent that the resin coating material is not bonded to a mold plate while the element is press-fitted into the mold plate.

DETAILED DESCRIPTION OF THE INVENTION

Figure 2A:
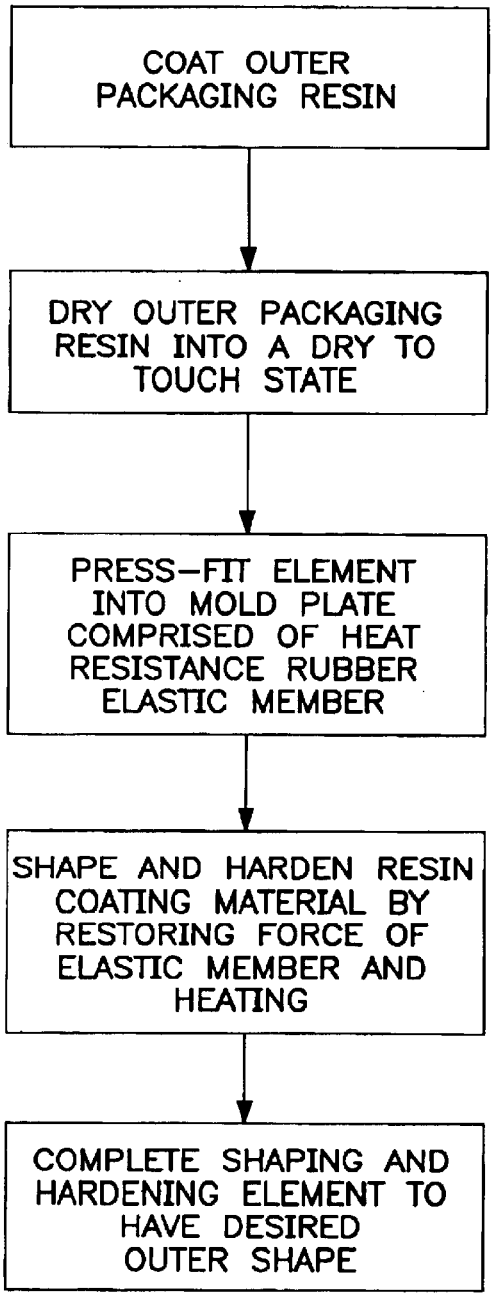
FIG. 2(A) is a flowchart illustrating steps involved in the second electronic chip component manufacturing method of the present invention.
Figure 2B:
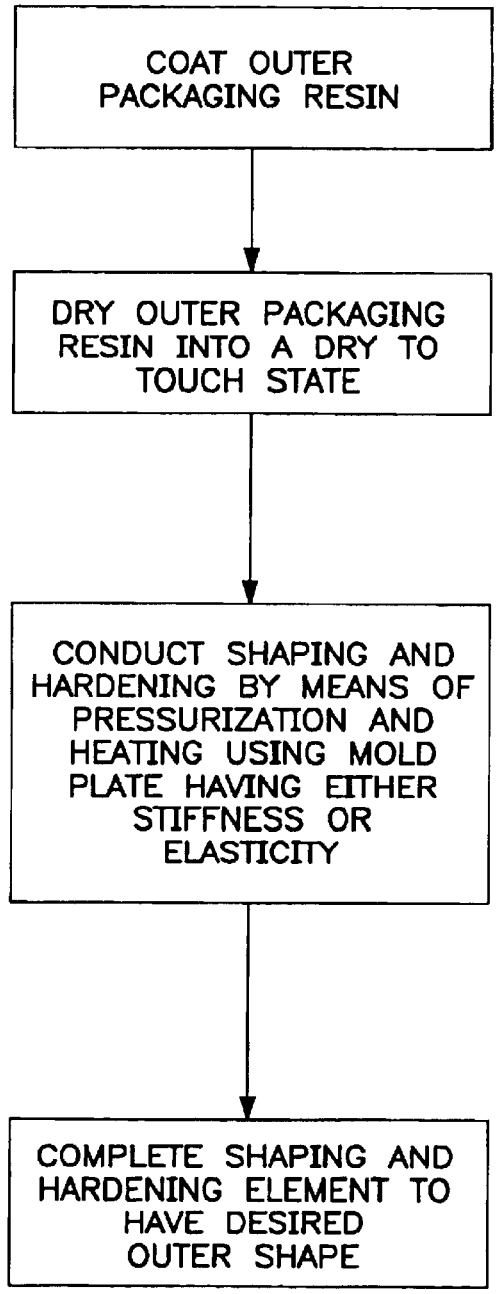
FIG. 2(B) is a flowchart illustrating steps involved in the third electronic chip component manufacturing method of the present invention.
Figure 6:
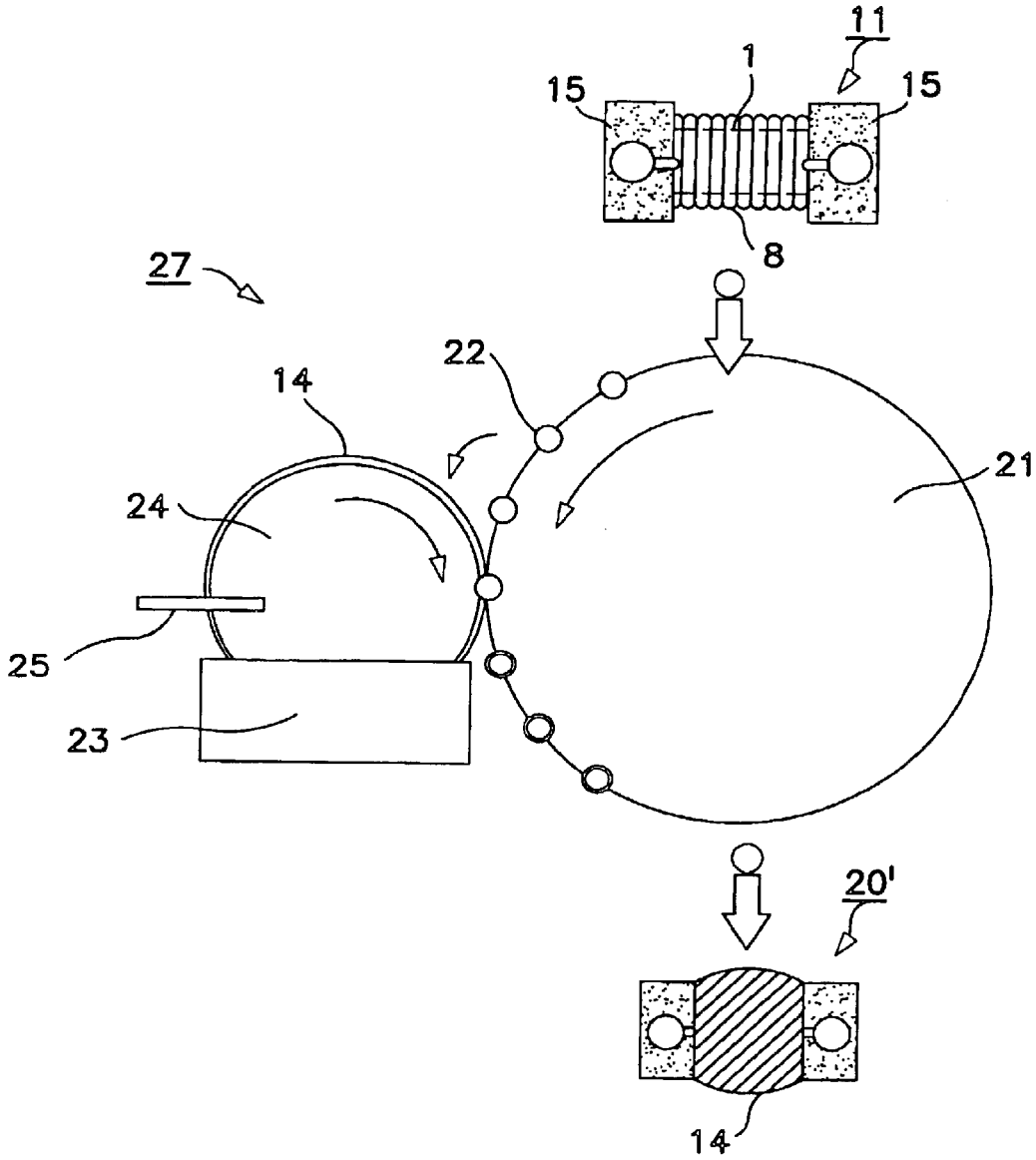
FIG. 6 is an explanatory view of manufacturing steps for coating a chip inductor element with a thermosetting resin coating material.
Figures 7A, 7B, 7C, 7D, 7E, 7F:
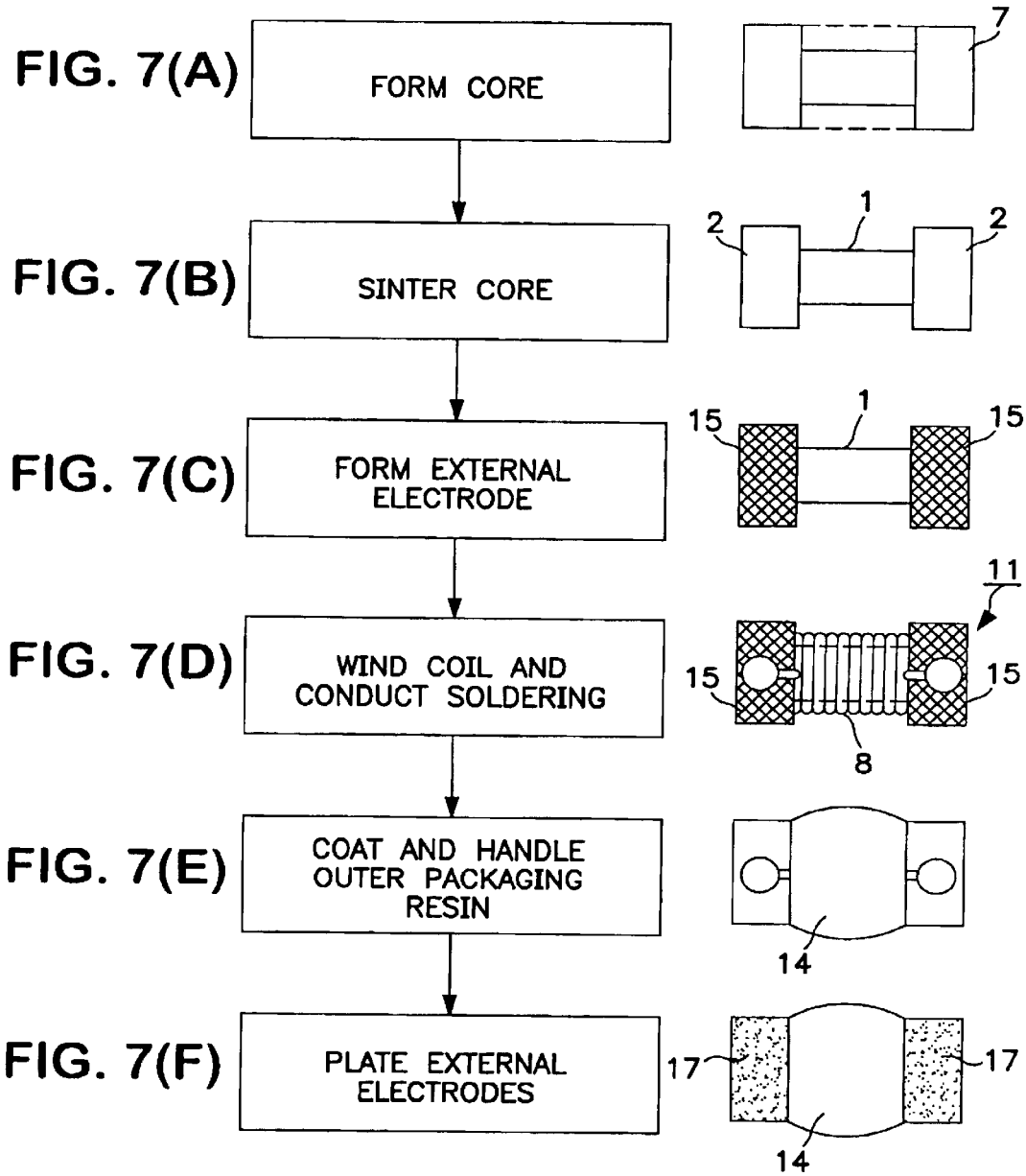
FIGS. 7(A)–7(B) form a flowchart outlining the steps involved in a chip inductor manufacturing method.

As can be understood from FIG. 2(A), FIG. 2(B) and FIG. 6, in a chip inductor manufacturing method according to the present invention, external electrodes 15 are provided on flange portions 2, 2 on the both ends of a double enveloping core 7, a coil 8 is wound around the core portion 1 of the double enveloping core 7, and the end portions of the coil 8 are connected to the external electrodes 15 to thereby form a chip inductor element 11. A resin coating material 14 (thermosetting resin) is then coated around the coil 8 of the chip inductor element 11 by means of a coater 27 shown in FIG. 6. Finally, heating and hardening of the coated resin coating material 14 is performed.

Figure 3:
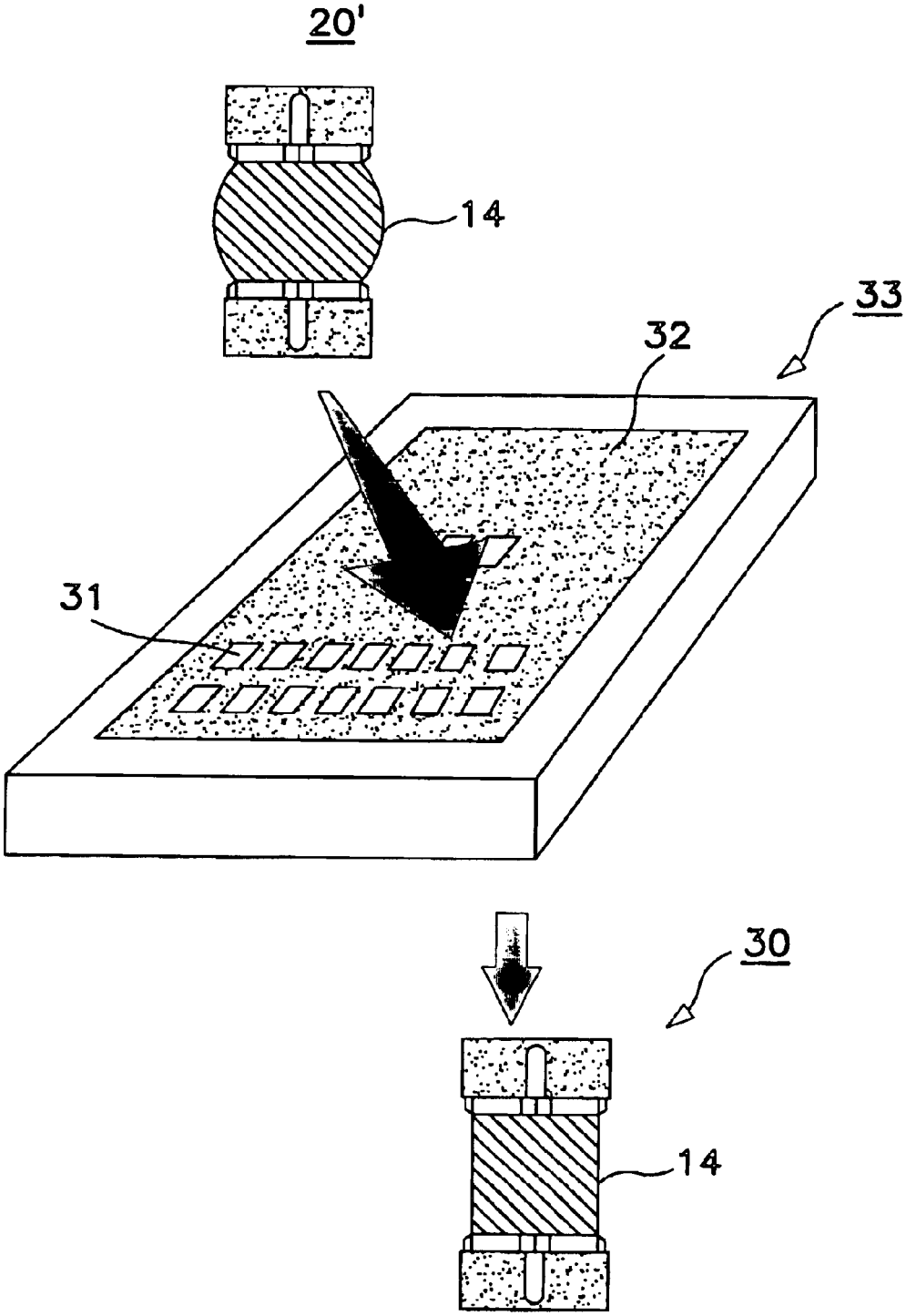
FIG. 3 is a perspective view for the first through fourth manufacturing methods which utilize means for shaping a resin coating material which coats the chip inductor according to the present invention by means of a mold plate comprised of a heat resistant rubber elastic member.

Namely, the method according to the present invention provides that, as shown in FIG. 3, a chip inductor element 20' (i.e., electronic chip component element) having a coated central portion swollen after the step of coating the outer packaging resin coating material, is press-fitted into a component storage section 31 made of a heat resistant rubber elastic member 32 (preferably silicon rubber) and having a desired outer shape, so that the component storage section 31 is elastically deformed and the chip inductor element 20' together with the heat resistant rubber elastic member 32 is heated. The resin coating material 14 is then shaped to have a desired outer package, and then hardened to thereby provide a chip inductor 30.

In the case of, for example, the above-stated rectangular chip inductor 30 having a rectangular parallelopiped shape, a mold plate 33 is prepared in which a plate-like heat resistant rubber elastic member 32 having many depressed-groove component storage sections 31 with generally the same dimensions and the same shape provided thereon is mounted, is prepared. The mold plate 33 is heated at, for example, 100 to 180° C. for about five minutes and dried to the extent that the resin coating material 14 is not completely hardened. More specifically, drying is carried out to the extent that the resin coating material 14, which has been coated when press-fitting the chip inductor element 20' into the component storage section 31 of the mold plate 33, is not yet bonded to the heat resistant rubber elastic member 32 of the mold plate 33.

Then, when the mold plate 33 is heated after press-fitting the element 20' into the component storage section 31, the portions at which the resin coating material 14 serving as the outer packaging material of the press-fitted chip inductor element 20' is swollen at excessive portions which are not matched with the dimensions. The excessive portions inevitably expand the space of the component storage section 31 of the heat resistant rubber elastic member 32, and the heat resistant rubber elastic member 32 is elastically deformed.

Figure 4A:
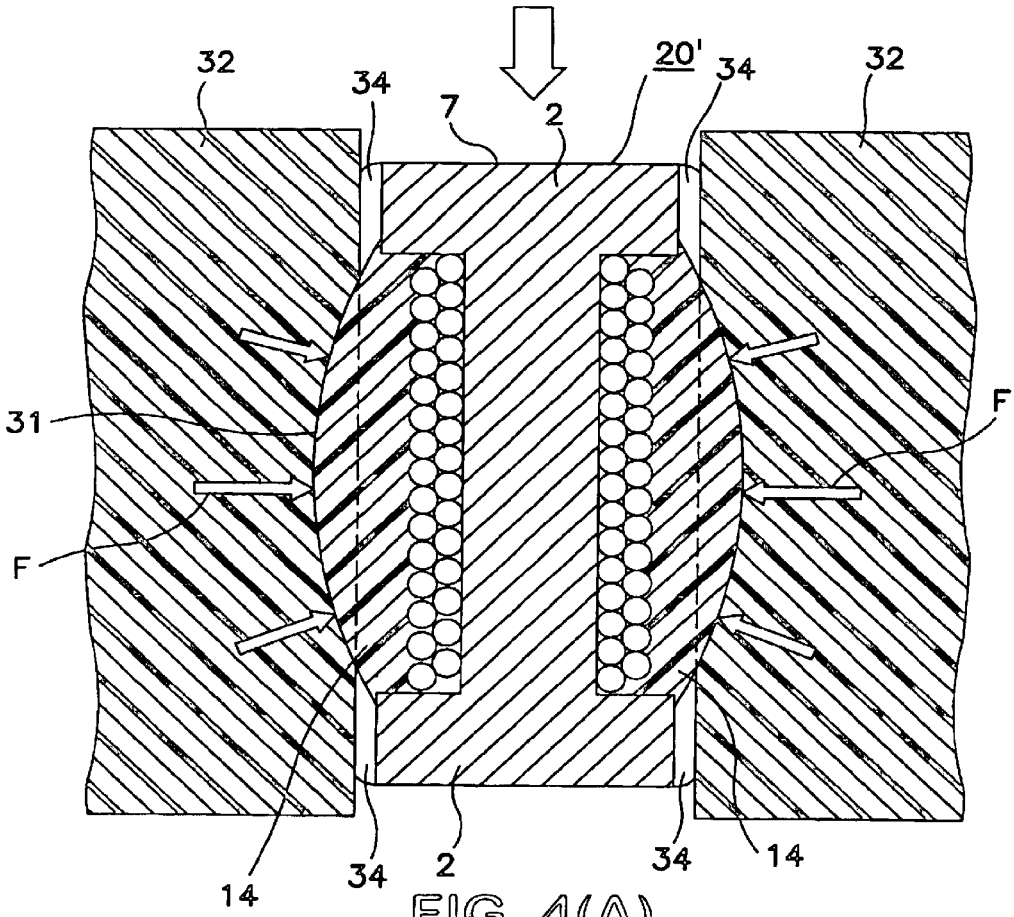
FIG. 4(A) is an enlarged cross-sectional view of a manufacturing method by the mold plate comprised of the heat resistant rubber elastic member.
Figure 4B:
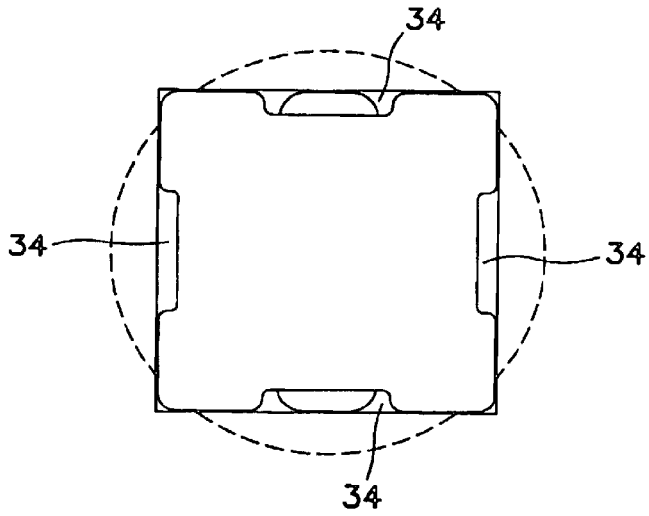
FIG. 4(B) is a partial top view of the cut away portion of the manufacturing method by the mold plate comprised of the heat resistant rubber elastic member shown in FIG. 4(A).
Figure 5A:
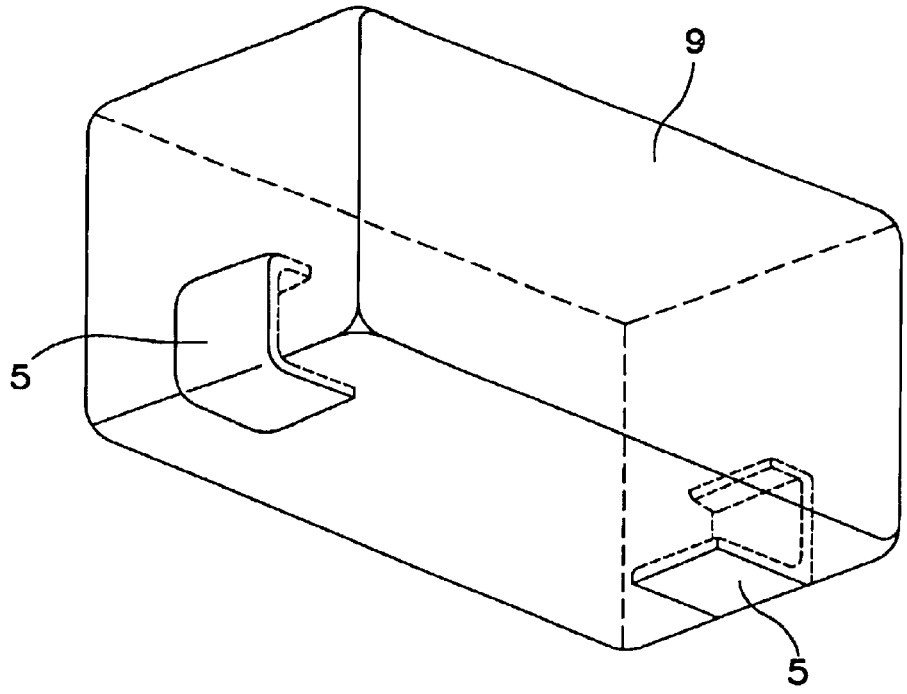
FIG. 5(A) is perspective view of a chip inductor formed by conventional injection molding, illustrating the outer periphery and position of the external electrodes thereon.
Figure 5B:
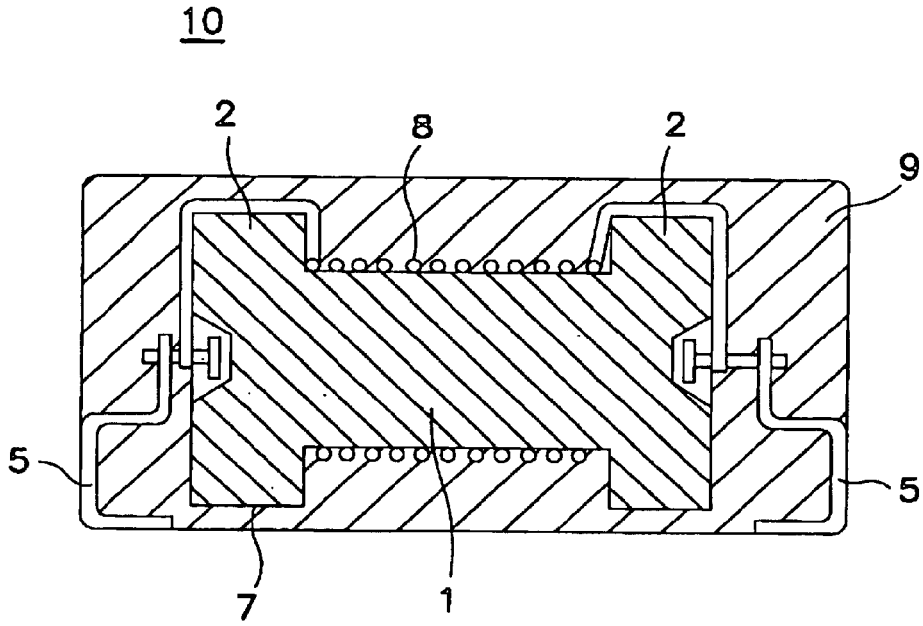
FIG. 5(B) is a cross-sectional view of the chip inductor shown in FIG. 5(A).

In reaction to the elastic deformation, restoring forces F, as shown in FIG. 4(A) and FIG. 4(B), are applied to the surfaces of the swollen portions according to the deformation from the heat resistant rubber elastic member 32. Further, a pressure resulting from the expansion of the heat resistant rubber elastic member 32 due to heating of the member 32 is also applied to the resin 14. The thermosetting resin coating material 14 in a dry-to-touch state is shaped in the heating and hardening process, and changed into a desired shape without swollen portions (as indicated by the broken line as shown in FIG. 4(A) and FIG. 4(B)) and hardened. This heating and hardening treatment is conducted at 140 to 180° C. for about 30 minutes to four hours.

It is thus possible to shape the resin coating material 14 coated as an outer packaging material into a desired shape, and heat and harden the material 14 only by the heating and hardening step.

The manufacturing method utilizing the restoring force of the heat resistant rubber elastic member 32 has a particularly great shaping effect in that when the shape of the above-stated component storage section 31 consists of a plurality of planes or a combination of a plurality of planes and a round ridgeline, i.e., the electronic chip component is of rectangular shape (typically rectangular parallelopiped shape), and later laborious grinding steps can be omitted.

Further, as shown in FIG. 4(A) and FIG. 4(B), it is preferable that run-off portions 34, to which the excessive portions of the resin coating material are extruded when heating the resin coating material 14, are provided at the flange sections 2, 2 on both ends of the double enveloping core 7 of the tip inductor (which flange portions may be disk shaped or rectangular parallelopiped shaped) or at portions of the corresponding component storage section 31. If so, smooth shaping operation during the shaping and hardening steps can be ensured.

Meanwhile, if consideration is given to the manufacturing method utilizing the restoring force of the heat resistant rubber elastic member 32 in the step flow shown in FIG. 2(A), it is found that a new manufacturing method can be derived therefrom.

That is, as shown in the flowchart of FIG. 2(B), if utilizing the dry-to-touch state, the chip is put into a mold plate of a desired outer shape having stiffness and heated while being pressurized, whereby the chip can be shaped and hardened to have a desired outer shape. Needless to say, when the chip shape is composed of a combination of planes, i.e., the chip is an electronic chip component of rectangular shape (typically rectangular parallelopiped shape), shaping can be easily performed by inserting the chip into metallic mold plats with one of the plates opened, pushing the chip against a push plate fitted into the opening surface, and pressurizing and heating the chip.

Furthermore, as shown in the flowchart of FIG. 2(B), if utilizing a dry-to-touch state, it is possible to shape and harden the chip component to have a desired outer shape by heating a pair of heat resistant rubber molds of desired shape with one of the molds opened, while the chip component is inserted into the component storage section of the plate molds and then pushed against a push plate fitted into the opening surface and pressurized.

While the elastic mold plate used in this embodiment is the same in shape as the above-stated mold plate having stiffness, the elastic plate has an advantage in that no excessive stress is applied to the inside structure of the electronic chip component due to its elastic property. It is noted that other thermosetting resins such as phenolic resin or silicon resin instead of the epoxy resin can be used for the resin coating material 14.

The rectangular chip inductor 30 manufactured by the above-stated manufacturing method has the same rectangular parallelopiped shape as those of a layered chip magnetic capacitor and a layered inductor, and allows successful surface mounting of one-by-one system by means of a chip mounter.

In the case of, in particular, a two-terminal inductor without polarity, it is possible to perform bulk mounting by shaping the end faces of the flange portions 2 on both ends of the double enveloping core 7 (ferrite core) into a generally square shape and the element into a uniform perpendicular parallelopiped shape provided with external electrodes directly bonded to the core on the respective flange portions 2 without vertical directionality.

If magnetic powder containing resin coating material having magnetic powder, such as ferrite powder, mixed into the resin is used as the resin coating material 14, and a closed magnetic circuit structure is formed, then it is possible to obtain a high inductance value and enhance shielding properties.

The element is coated with the resin coating material 14 serving as an outer packaging material, and then the coating material 14 is dried to a dry-to-touch state to thereby form and, at the same time, harden the element, whereby it is possible to form the outer element into a desirable dimension without conducting a grinding step and to improve the look of the element at lower cost.

Figure 1A:
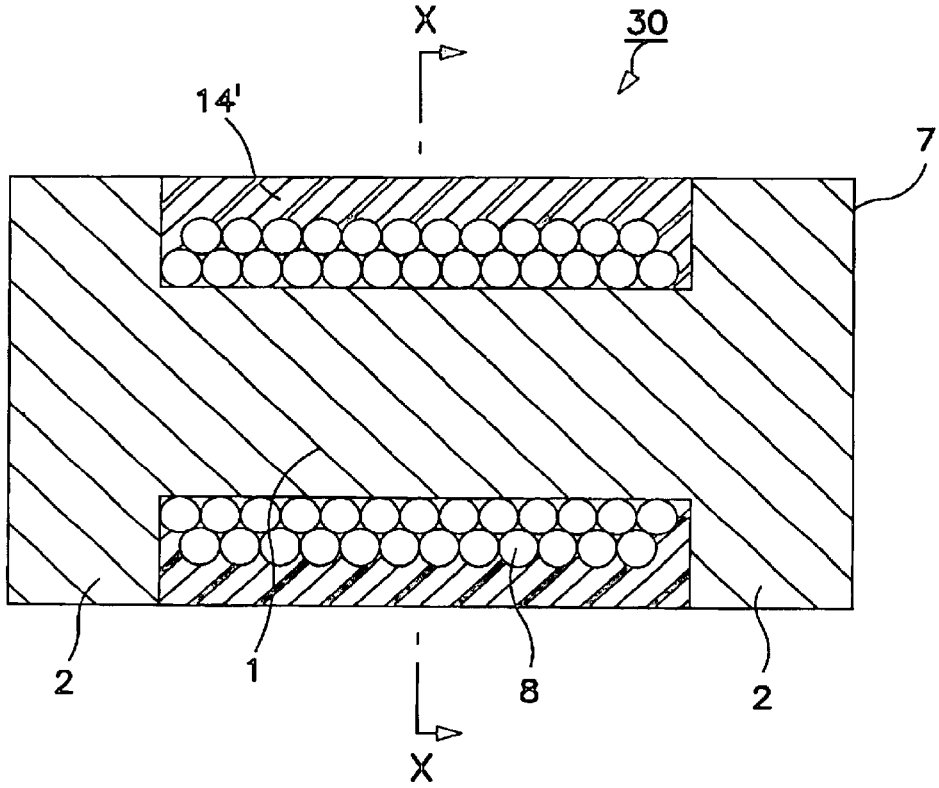
FIG. 1(A) is a longitudinal cross-sectional view of a chip inductor according to the present invention.
Figure 1B:
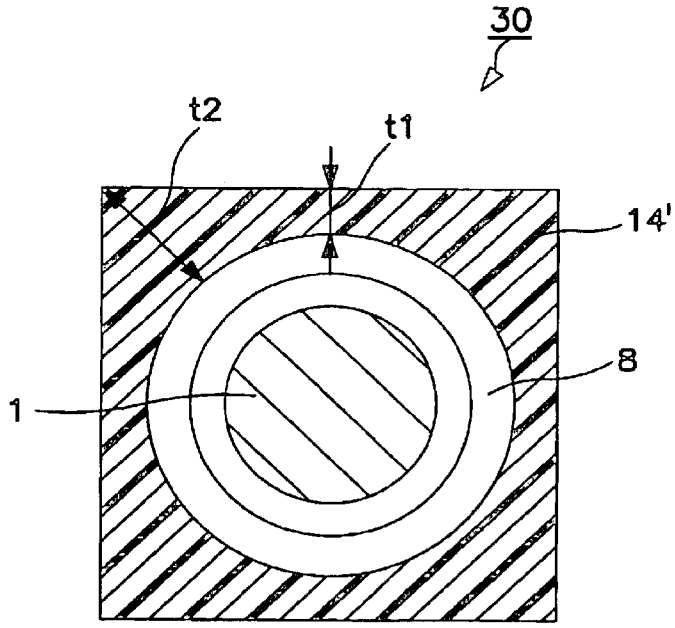
FIG. 1(B) is a cross-sectional view of the chip inductor shown in FIG. 1(A)

The rectangular chip inductor 30 shown in the longitudinal sectional view of FIG. 1(A) and the cross-sectional view taken along line X—X of FIG. 1(B), has rectangular flange portions 2, 2, and the core portion 1 is a round core having a round cross section. The round core type allows the densest winding of the coil 8 around the core. By arranging the magnetic powder containing resin 14' serving as the outer packaging material particularly in the four corners, it is possible to obtain a small-sized electronic component having a low direct current resistance.

The dimensional ratio t2/t1 of the thickness t1 of the circumferential thin portion of the magnetic powder containing resin 14' (which may be resin coating material 14) serving as an outer packaging material formed on the outer periphery of the element to the thickness t2 of the thick portion thereof is not less than 2, so that at least part of the respective flange portions 2, 2 are exposed. This dimensional ratio is obtained as a result of shaping the outer packaging material manufactured by the above-stated manufacturing method so as not to exceed the outer dimensions of the chip inductor element, i.e., so that the outer packaging material is almost flush with the outer peripheral surfaces of the flanges 2 as shown in FIG. 1(A). The dimensional characteristics of the outer packaging material, i.e., the dimensional ratio t2/t1 of not less than 2 is also applicable to the core having a rectangular core portion.

The electronic chip component produced by the manufacturing method of the present invention is characterized in that a dimensional ratio t2/t1 of the thickness t1 of the circumferential thin portion of the outer packaging material to the thickness t2 of the thick portion thereof is not less than 2. Needless to say, the above characteristic is not limited to the chip inductor, but is also applicable to any electronic chip component element having flanges on both longitudinal ends and having the outer packaging coated around the element. Even when the outer packaging material used is magnetic powder containing resin material 14' containing magnetic powder of 75% by weight or more, it can be easily shaped, and magnetic characteristics are enhanced.

Moreover, the largest particle size of the magnetic powder contained in the magnetic powder containing resin 14' serving as an outer packaging material is not greater than the thickness t1 of the circumferential thin portion of the outer packaging material, the magnetic powder is not exposed at the thin portion, and does not damage the coil while the outer packaging material is shaped.

The electronic chip component and the electronic chip component manufacturing method according to the present invention have the following advantages:

(1) Since an outer packaging material which does not exceed the outer dimensions of the electronic chip component element is coated around the element, it is possible to make the electronic chip component small in size and obtain good shaping characteristics.

(2) Since magnetic powder containing resin having a high magnetic powder content is used as an outer packaging material, it is possible to both make an electronic chip component small in size and a direct current resistance thereof low.

(3) By limiting the largest particle size of the magnetic powder to be not more than the thickness t1 of the circumferential thin portion of the outer packaging material, it is possible to prevent the magnetic powder from being exposed at the thin portion and from damaging the coil while the outer packing material is being shaped.

(4) The electronic chip component manufacturing method allows the thermosetting resin coating material which coats the element to be shaped and hardened into a desired shape by the restoring force caused by the elastic deformation of the heat resistant rubber elastic member.

(5) According to the electronic chip component manufacturing method since the electronic component element is press-fitted into the component storage section of the heat resistant rubber elastic member, particularly with the thermosetting resin coating material coating the electronic component element in a dry-to-touch state, the thermosetting resin coating material is shaped and hardened without being bonded to the heat resistant rubber elastic member to thereby facilitate the later easy removal of the element from the component storage section.

(6) According to the manufacturing method of a chip inductor called for in irregular coil winding is prevented during injection molding, and the swollen portions of the coating material as a result of coating the element with the material are automatically shaped in the thermosetting step. Thus, there is no need to conduct a grinding step and it is, therefore, possible to obtain a desired chip shape quite easily in the outer packaging formation step.

(7) According to the manufacturing method for a chip inductor having an outer shape consisting of a plurality of planes or of a combination of a plurality of planes and a round a laborious shaping process by means of grinding becomes unnecessary, and the automatic shaping in the thermosetting step can be made at advantageously lower cost.

(8) According to the manufacturing method since the run-off grooves provided in flange portions on both ends of the chip inductor make it possible to flow off excessive resin in the sharpening and hardening step, it is possible to advantageously shape the element smoothly.

(9) According to the manufacturing method a mold plate having stiffness such as a metallic mold is used, pressurized and heated, whereby it is possible to automatically form the element into desired dimensions, as in the case of using the above-stated heat resistant rubber elastic member in the resin hardening step.

(10) According to the manufacturing method the elastic mold plate having elastic rubber provided on its surfaces is used, pressurized and heated, whereby the method has an advantage in that no excessive stress is applied to the inside structure of the electronic component as in the case of using the above-stated heat resistant rubber elastic member.

| Reference Numerals | |
|---|---|
| 7 | double enveloping core |
| 8 | coil |
| 14 | resin coating material |
| 14' | magnetic powder containing resin |
| 10, 20, 30 | chip inductor |
| 20' | chip inductor element |
| 27 | coater |
| 31 | component storage section |
| 32 | heat resistance rubber elastic member |
| 33 | mold plate |
| t1 | thickness of circumferential thin portion of outer packaging material |
| t2 | thickness of circumferential thick portion of outer packaging material |

What is claimed is:

1. An electronic chip component comprising:

an element having flanges on longitudinal both ends, respectively, and an outer packaging material coating a periphery of said element having a circumferential thin portion and circumferential thick portion, wherein a dimensional ratio (t2/t1) of a thickness (t1) of a circumferential thin portion of the outer packaging material formed on the outer periphery of the element to a thickness (t2) of a thick portion of the outer packaging material is not less than 2 so that at least part of the respective flanges are exposed.

2. The electronic chip component according to claim 1, wherein the outer packaging material is magnetic powder containing resin containing magnetic powder of 75% by weight or more.

3. The electronic chip component according to claim 2, wherein a particle size of the magnetic powder contained in the outer packaging material is not greater than the thickness (t1) of the circumferential thin portion of the outer packaging material.

* * * * *